US006832438B1

(12) United States Patent
Gringer et al.

(10) Patent No.: US 6,832,438 B1
(45) Date of Patent: Dec. 21, 2004

(54) UTILITY KNIFE WITH QUICK RELEASE HOUSING

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 296 days.

(21) Appl. No.: 09/874,665

(22) Filed: Jun. 5, 2001

(51) Int. Cl.[7] ..... B26B 1/08
(52) U.S. Cl. ..... 30/162; 30/335
(58) Field of Search ..... 30/162, 335

(56) References Cited

U.S. PATENT DOCUMENTS

| | | | | |
|---|---|---|---|---|
| 2,245,096 A | | 6/1941 | Penney | |
| 2,376,887 A | | 5/1945 | Walters | |
| 2,862,296 A | | 12/1958 | Anderson | |
| 2,948,961 A | | 8/1960 | Ortner | |
| 3,107,426 A | | 10/1963 | Robinson, Jr. | |
| 3,192,624 A | | 7/1965 | Gringer | |
| 5,022,156 A | | 6/1991 | Kallens et al. | |
| 5,025,558 A | | 6/1991 | Gilbert | |
| 5,121,544 A | * | 6/1992 | Gilbert | 30/335 |
| 5,141,517 A | * | 8/1992 | Shutt | 30/162 |
| 5,426,855 A | * | 6/1995 | Keklak et al. | 30/162 |
| 5,433,004 A | | 7/1995 | Thompson et al. | |
| 5,545,175 A | * | 8/1996 | Abidin et al. | 30/162 |
| 5,581,890 A | * | 12/1996 | Schmidt | 30/162 |
| 5,813,121 A | | 9/1998 | Gringer | |
| 6,044,562 A | | 4/2000 | Dillenbeck | |
| 6,058,607 A | | 5/2000 | Gringer | |
| 6,219,923 B1 | * | 4/2001 | Sinisi et al. | 30/162 |
| 6,286,215 B1 | * | 9/2001 | Panaccione | 30/335 |
| 6,349,473 B1 | * | 2/2002 | Schmidt | 30/335 |
| 6,438,849 B1 | * | 8/2002 | Wonderley | 30/161 |

* cited by examiner

*Primary Examiner*—Hwei-Siu Payer
(74) *Attorney, Agent, or Firm*—Gottlieb, Rackman & Reisman, PC

(57) ABSTRACT

A cutting device includes (i) a housing having first and second separable portions, the first portion having a locking aperture, the second portion having an attachment aperture, and (ii) a locking apparatus for removably locking the first and second portions of the housing. The locking apparatus includes an attachment portion for being fixedly attached in the attachment aperture, and a locking arm adapted to be releasably locked into the locking aperture. The attachment aperture and locking aperture are correspondingly positioned so that the locking arm becomes aligned with the locking aperture when the first and second portions of the housing are aligned for assembly. The housing may be constructed of metal, and the locking apparatus constructed of plastic. The locking apparatus may also include a return spring and blade carrier integrally molded therewith. In one embodiment, the locking arm includes i) an upstanding portion oriented generally perpendicular to an axis of the housing, ii) an actuating arm extending laterally from a free end of the upstanding portion, so that downward force on the actuating arm causes a bending of the upstanding portion, and iii) a locking lip toward the free end of the upstanding portion extending laterally in a direction opposite to the direction of bending of the upstanding portion.

11 Claims, 8 Drawing Sheets

UTILITY KNIFE WITH QUICK RELEASE HOUSING

BACKGROUND OF THE INVENTION

1. Field of the Invention

The present invention relates to a locking mechanism for a utility knife, and more particularly to a quick release locking mechanism for a utility knife, wherein the locking mechanism may be used with a utility knife having a metal housing or may be integral with the blade carrier and/or return spring in an automatically retractable utility knife.

2. Description of the Related Art

Utility knives are well known in the art, and typically include a housing, which is often constructed of separable halves, a blade carrier, which holds a razor or other blade, and a handle or thumb piece attached to the blade carrier and extending from the housing to enable the blade to be extended from and retracted into the housing. Utility knives are available in automatically retractable and indexed versions.

In an automatically retractable utility knife, a spring is attached between the housing and the blade carrier to automatically retract the blade into the housing upon release of the thumb piece. The spring tension is such that when the blade is projected and inserted in a material being cut, e.g., cardboard, the friction between the blade and the material is sufficient to retain the blade in the projected position. In an indexed utility knife, the blade may be moved between one of several locked positions, including fully retracted and fully extended positions.

In many utility knives, the housing is constructed of two halves which are attached by means of a screw located toward the center of the housing. In order to replace the blade, it is necessary to unscrew the halves of the housing, which requires a screwdriver, and which is both time consuming and inconvenient. To overcome this shortcoming, utility knives with plastic housings have been developed that incorporate a locking mechanism that may be released without tools. For example, U.S. Pat. No. 5,121,544 relates to a utility knife that is constructed of separable plastic halves and that includes a rear snap-locking mechanism. In order to operate the locking mechanism, the user must push an actuating lever and slide the halves in opposite directions generally parallel to a central axis of the housing, i.e., generally parallel to the direction of movement of the blade, before the halves release from each other.

Commonly-owned U.S. Pat. Nos. 6,058,607 and 5,813,121, the contents of which are incorporated herein by reference, disclose a utility knife locking mechanism that includes a resilient locking arm on a first half of the housing, and a locking aperture on the other half of the housing. In use, the locking arm is pushed into the locking aperture to lock the halves of the housing together. When the locking arm is depressed, it becomes released from the locking aperture to allow the housing to be opened.

Quick-release locking mechanisms of this type have been utilized only in plastic knives, in which the locking mechanism may be molded integrally with the housing, and in which the materials are sufficiently flexible to enable the locking arm to be released. Such locking mechanisms have not been used in metal housings, since the metals used are often too rigid to be used in the locking mechanism.

Accordingly, it would be desirable to have a quick-release locking mechanism for a utility knife that may be used with knife having a metallic housing. More generally, it would be desirable to have a quick-release locking mechanism for a utility knife that is separable from the housing itself so that the locking mechanism may be used with housings constructed of materials unsuitable for being constructed integral with the locking mechanism.

SUMMARY OF THE INVENTION

The present invention is a cutting device comprising (i) a housing having first and second separable portions, the first portion comprising a locking aperture, the second portion comprising an attachment aperture, and (ii) a locking apparatus for removably locking the first and second portions of the housing. The locking apparatus comprises an attachment portion for being fixedly attached in the attachment aperture, and a locking arm adapted to be removably locked into the locking aperture. The attachment aperture and locking aperture are correspondingly positioned so that the locking arm becomes aligned with the locking aperture when the first and second portions of the housing are aligned for assembly. If desired, the housing may be constructed of metal, and the locking apparatus constructed of resilient plastic, such as Celcon, ABS, or Polycarbobate. The locking apparatus may also comprise a return spring and blade carrier integrally molded therewith.

In one embodiment, the locking arm comprises i) an upstanding portion oriented generally perpendicular to an axis of the housing, ii) an actuating arm extending laterally from a free end of the upstanding portion, so that downward force on the actuating arm causes a bending of the upstanding portion, and iii) a locking lip toward the free end of the upstanding portion extending laterally in a direction opposite to the direction of bending of the upstanding portion. The attachment aperture comprises at least one attachment shoulder, and the attachment portion of the locking apparatus comprises at least one corresponding extension for being locked in the attachment aperture against the attachment shoulder.

In an improved cutting device having a housing formed of first and second portions, a return spring, and a blade carrier biased by the return spring, the improvement comprises a locking apparatus for releasably attaching the first and second portions of the housing, the locking apparatus being integrally molded with the return spring and the blade carrier. In one embodiment, (i) the first portion of the housing comprises a locking aperture, and the second portion of the housing comprises an attachment aperture, and (ii) the locking apparatus comprises an attachment portion for being fixedly attached in the attachment aperture, and a locking arm adapted to be removably locked into the locking aperture. The attachment aperture and locking aperture are correspondingly positioned so that the locking arm becomes aligned with the locking aperture when the first and second portions of the housing are aligned for assembly. If desired, the housing may be constructed of metal, and the locking apparatus constructed of plastic.

Also disclosed is a cutting device comprising a housing and an integrally molded A blade carrier, return spring, and releasable housing lock disposed within the housing.

Another embodiment of the invention discloses a cutting device comprising (i) a metallic housing comprising first and second separable portions, and (ii) a plastic locking apparatus for removably locking the first and second portions of the housing, the locking apparatus comprising an attachment portion for being fixedly attached to the first portion of the housing, and a locking arm adapted to be removably locked to the second portion of the housing.

BRIEF DESCRIPTION OF THE DRAWINGS

FIG. 17A is a side view of the locking mechanism of the embodiment of the invention shown in FIG. 16A.

FIG. 17B is an end view of the locking mechanism shown in FIG. 17A.

FIG. 17C is a bottom view of the locking mechanism shown in FIG. 17A.

DETAILED DESCRIPTION OF THE INVENTION

Figure 1:
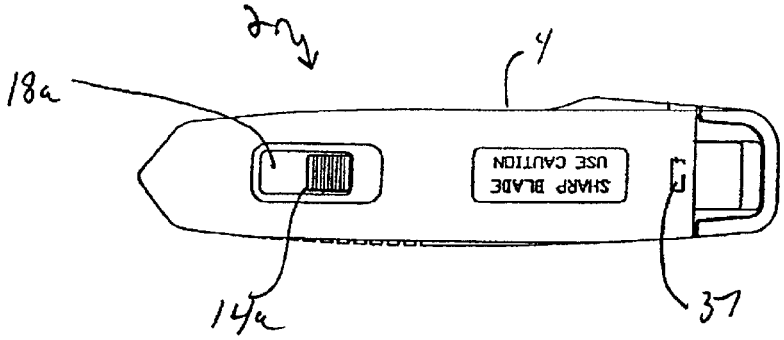
FIG. 1 is a right side view of an automatically-retractable utility knife in accordance with the present invention with the blade in the retracted position.
Figure 2:
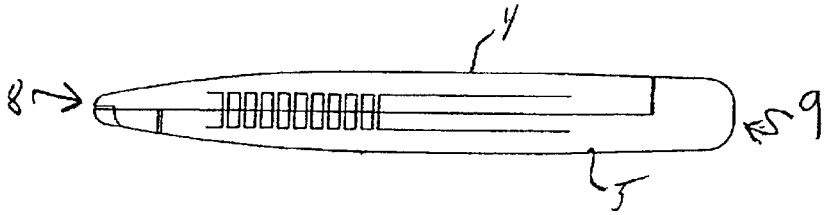
FIG. 2 is a top view of the automatically-retractable utility knife shown in FIG. 1.
Figure 3:
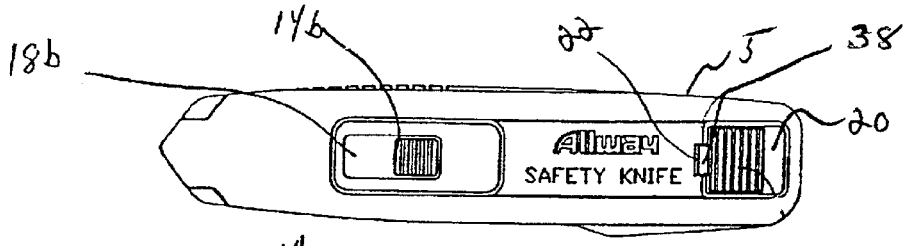
FIG. 3 is a left side view of the automatically-retractable utility knife shown in FIG. 1.

The present invention is a utility knife having a quick release locking mechanism. While the invention will be initially described with respect to an automatically retractable utility knife, in which the locking mechanism may be integral with the blade carrier and/or spring, the invention is applicable to any appropriate utility knife, including metallic utility knives and indexed knives, as discussed below with respect to FIGS. 16–18. Moreover, while the invention will be described with respect to a particular housing configuration, it is generally applicable to attach the housing portions of any multi-piece housing.

As shown in FIGS. 1–10, the present invention is a utility knife 2 having a housing constructed of an upper housing 4 and a lower housing 5, and a blade carrier 12 movable therein. A thumb piece or thumb pieces 14*a*, 14*b* are preferably integrally molded with blade carrier 12 and extend through respective corresponding guide slots 18*a*, 18*b* so that movement of thumb pieces 14*a*, 14*b* along guide slots 18*a*, 18*b* by the user causes projection and retraction of a cutting blade 10.

Referring to FIGS. 5–12, utility knife 2 can be seen with either upper housing 4 or lower housing 5 removed. Blade carrier 12 is preferably integrally molded with an automatically retractable return spring 6, as disclosed in commonly owned U.S. Pat. Nos. 6,058,607 and 5,813,121, the contents of which are incorporated herein in their entireties. The other end of return spring 6 is attached to a locking mechanism, shown generally as 100, that engages with upper housing 4 and that releasably attaches upper housing 4 to lower housing 5. Locking mechanism 100 includes apertures 33 through which pins 16 on upper housing 4 extend when the locking mechanism is attached to the upper housing in order to stabilize and align the locking mechanism. Extensions 35 on locking mechanism 100 define locking shoulders 36 (shown in greater detail as 136 in FIG. 17B), which are inserted into an attachment aperture 37 on upper housing 4 to attach the locking mechanism to the upper housing. During insertion into attachment aperture 37, extensions 35 flex inwardly until shoulders 36 are able to engage with and lock against aperture 37. Once inserted into attachment aperture 37, locking mechanism 100 is preferably fixed within the aperture, although removal may be possible through mechanical manipulation of extensions 35. If desired, a release mechanism for the attachment mechanism may be used, or any appropriate alternative attachment mechanism may be used to attach locking mechanism 100 to upper housing 4. Locking mechanism 100 is preferably integrally molded with return spring 6 and blade carrier 12, and is preferably constructed of a resilient material, such as a molded thermoplastic.

Figure 4:
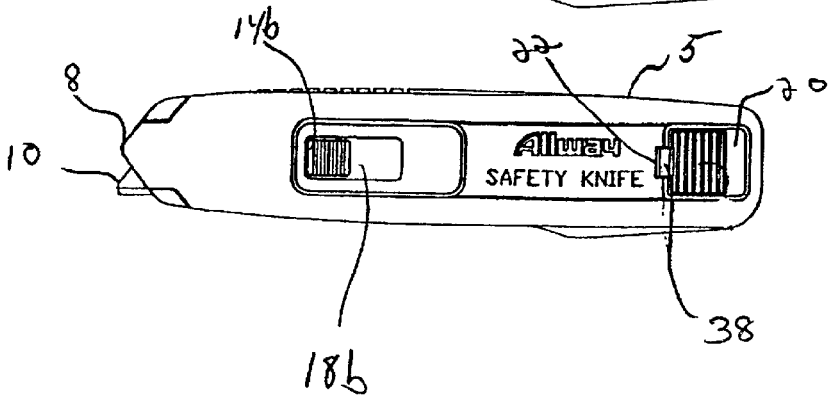
FIG. 4 is a left side view of the automatically-retractable utility knife shown in FIG. 1 with the blade in an extended position.
Figure 5:
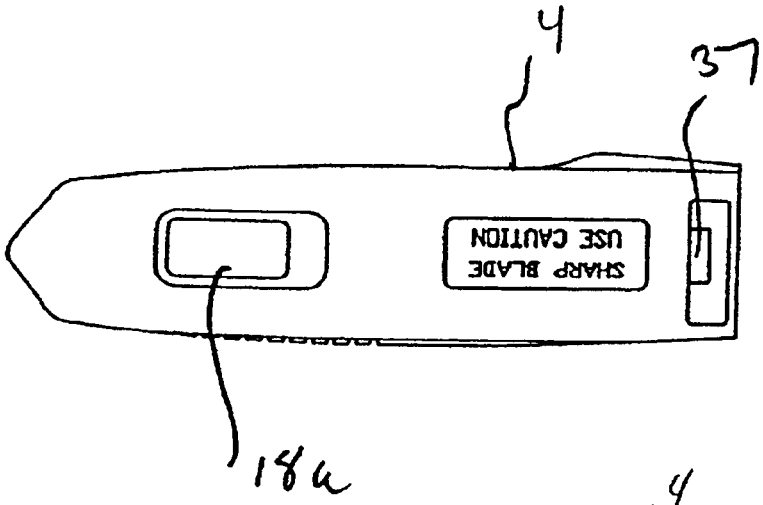
FIG. 5 is a right side view of the upper housing of the automatically-retractable utility knife shown in FIG. 1.
Figure 6:
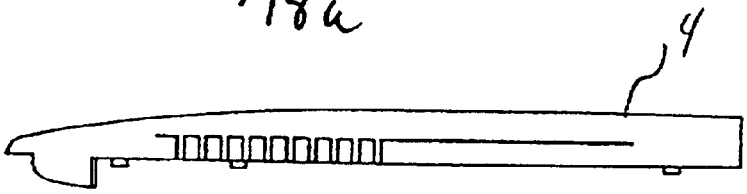
FIG. 6 is a top view of the upper housing shown in FIG. 5.
Figure 7:
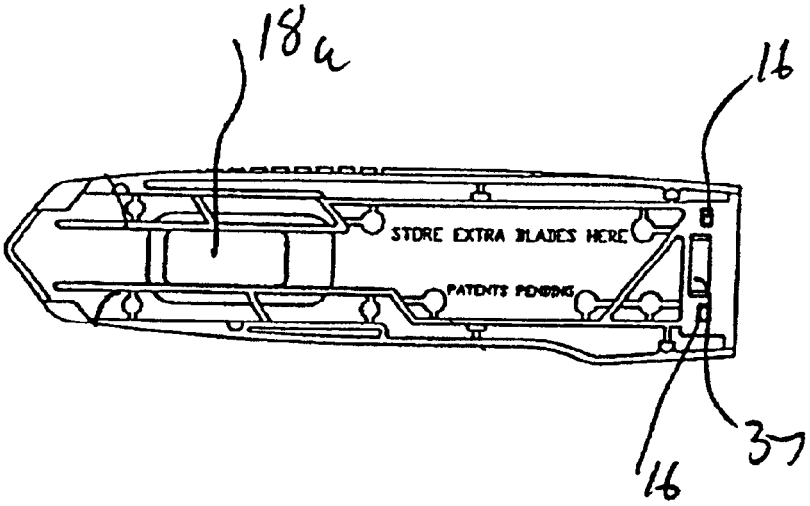
FIG. 7 is a left side view of the upper housing shown in FIG. 5.
Figure 8:
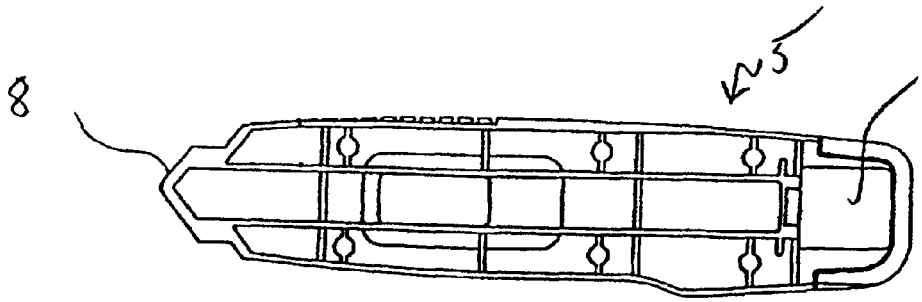
FIG. 8 is a right side view of the lower housing of the automatically-retractable utility knife shown in FIG. 1.
Figure 9:
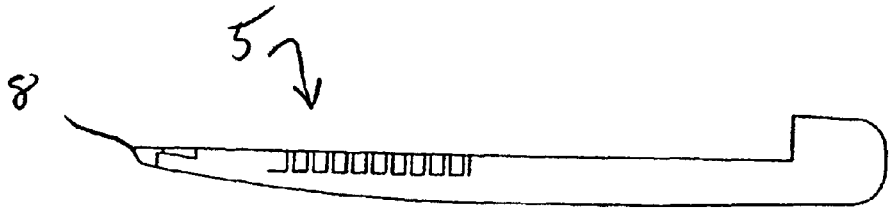
FIG. 9 is a top view of the lower housing shown in FIG. 8.
Figure 10:
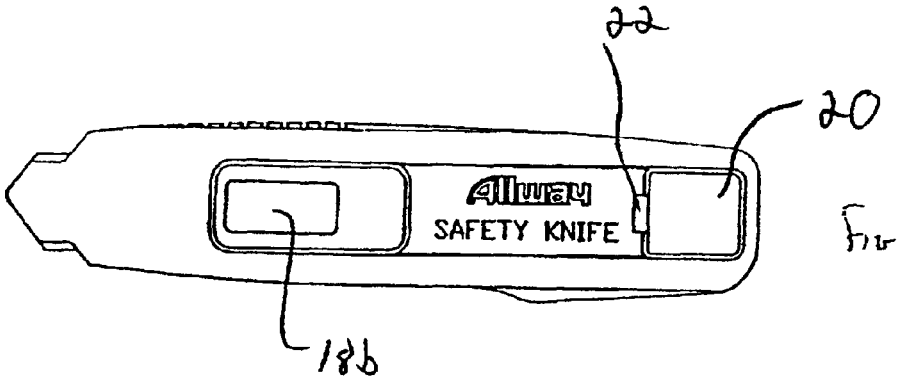
FIG. 10 is a left side view of the lower housing shown in FIG. 8.
Figure 11:
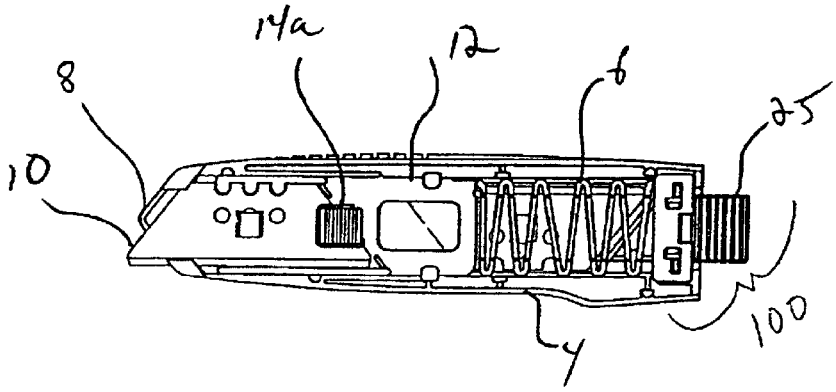
FIG. 11 is a left side view of the upper housing of the automatically-retractable utility knife shown in FIG. 1 with the blade carrier, return spring and locking mechanism positioned therein, with the blade in an extended position.
Figure 12:
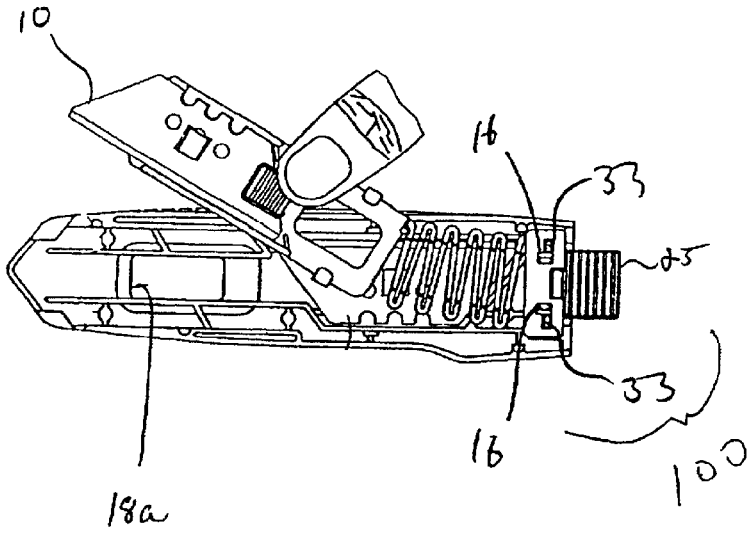
FIG. 12 is a left side view of the interior of the upper housing shown in FIG. 11 with the blade carrier positioned to expose the spare blade holding area.

FIGS. 4 and 11 show the automatically retractable utility knife with blade carrier 12 in an extended position, exposing blade 10 from within the housing on the distal end 8 thereof. In each of these positions return spring 6 is under tension and provides a retraction force on blade carrier 12 toward the rear of lower housing 5. A force applied to thumb piece 14 causes blade carrier 12 to move toward distal end 8 of the housing, thereby placing return spring 6 under additional tension and exposing blade 10. Once thumb piece 14 is released, return spring 6 automatically pulls blade carrier 12 toward the rear of the housing, thereby retracting blade 10 to a position completely within the housing.

Figure 13:
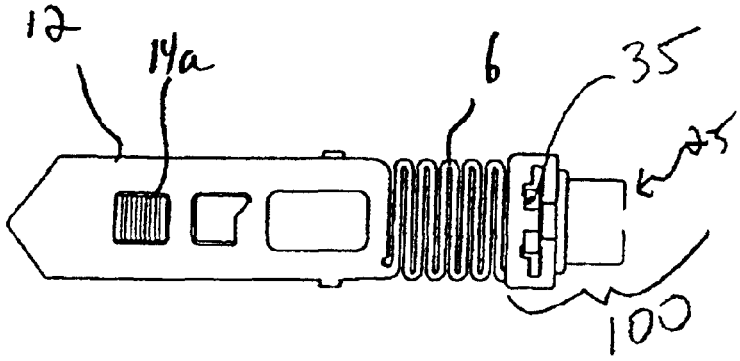
FIG. 13 is a bottom view of an automatically-retractable blade carrier in accordance with the invention.
Figure 15:
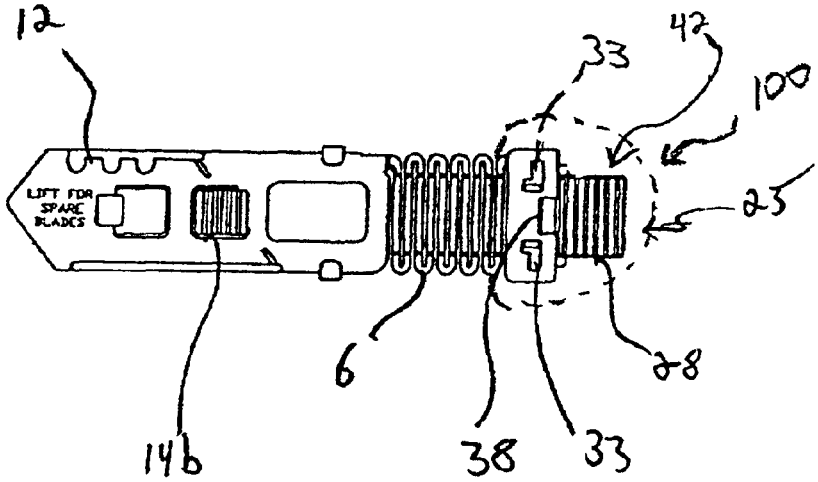
FIG. 15 is a top view of the automatically-retractable blade carrier shown in FIG. 13.
Figure 14:
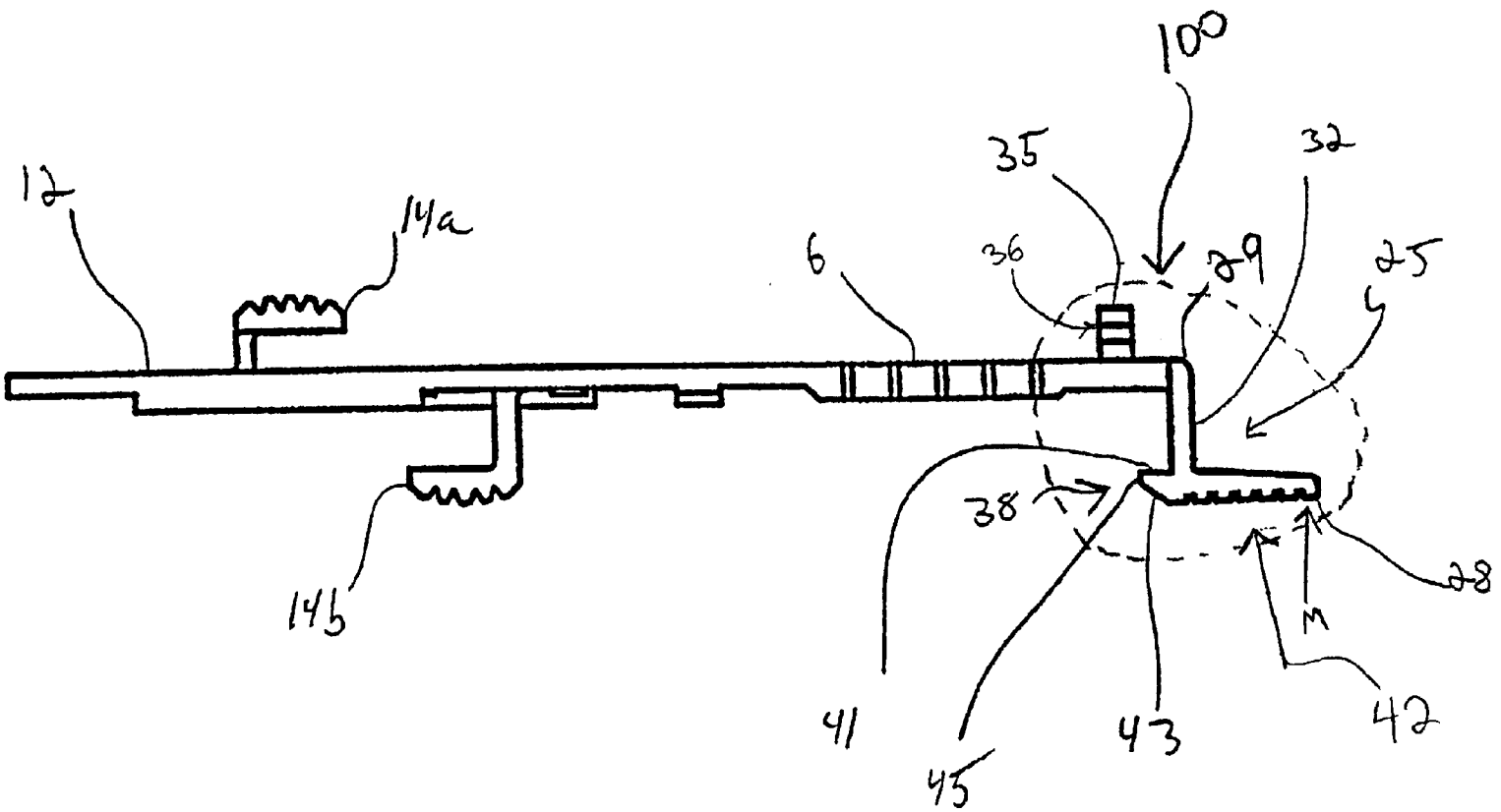
FIG. 14 a side view of the automatically-retractable blade carrier shown in FIG. 13.

Referring to FIGS. 13–15, locking mechanism 100 includes a locking arm 25 integrally molded therewith, which is adapted to fit into a locking aperture 20 on lower housing 5. Lower housing 5 preferably includes a locking shoulder 22 on the peripheral edge of aperture 20, and locking arm 25 includes an upwardly extending portion 32 and an actuating arm 28 preferably having a plurality of ribs 42 providing a gripping surface. Locking arm 25 preferably includes a locking lip 38 having flat under surface 41 that is adapted to frictionally engage shoulder 22. Locking arm 25 also preferably includes a tapered surface 43 adjacent to flat under surface 41, which is adapted to slidably engage an underside of shoulder 22. Tapered surface 43 and flat under surface 41 preferably are adjoined at edge 45, where edge 45 is preferably positioned at an angle of at least 90 degrees relative to flat under surface 41, although any appropriate angle may be utilized consistent with releasably locking upper housing 4 to lower housing 5.

As upper housing 4 is brought into contact with lower housing 5, locking arm 25 releasably engages aperture 20. During insertion of locking arm 25 into aperture 20, tapered surface 43 slidably engages the underside of shoulder 22, causing upwardly extending portion 32 to flex away from the edge of aperture 20. As locking arm 25 moves past the edge of aperture 20, tapered surface 43 continues to move along the underside of shoulder 22. As the distal end of tapered surface 43 moves past the underside of shoulder 22, edge 45 engages and advances past shoulder 22 and locking arm 25 "snaps" into substantially parallel axial alignment with lower housing 5 while flat under surface 41 frictionally engages and seats on shoulder 22. While in this position, locking arm 25 securely attaches upper housing 4 and lower housing 5.

In order to open the housing, downward pressure is applied onto actuating arm 28 of locking arm 25 in direction M as shown in FIG. 14. As force is applied to actuating arm 28, locking arm 25 rotates around point 29 causing upwardly extending portion 32 to bend slightly. As locking arm 25 rotates, flat under surface 41 moves away from shoulder 22, and eventually advances past shoulder 22, disengaging upper housing 4 and lower housing 5. The housing may then be opened by pulling the upper and lower housings apart in a direction generally perpendicular to the axis of the housing.

Figures 16A, 16B:
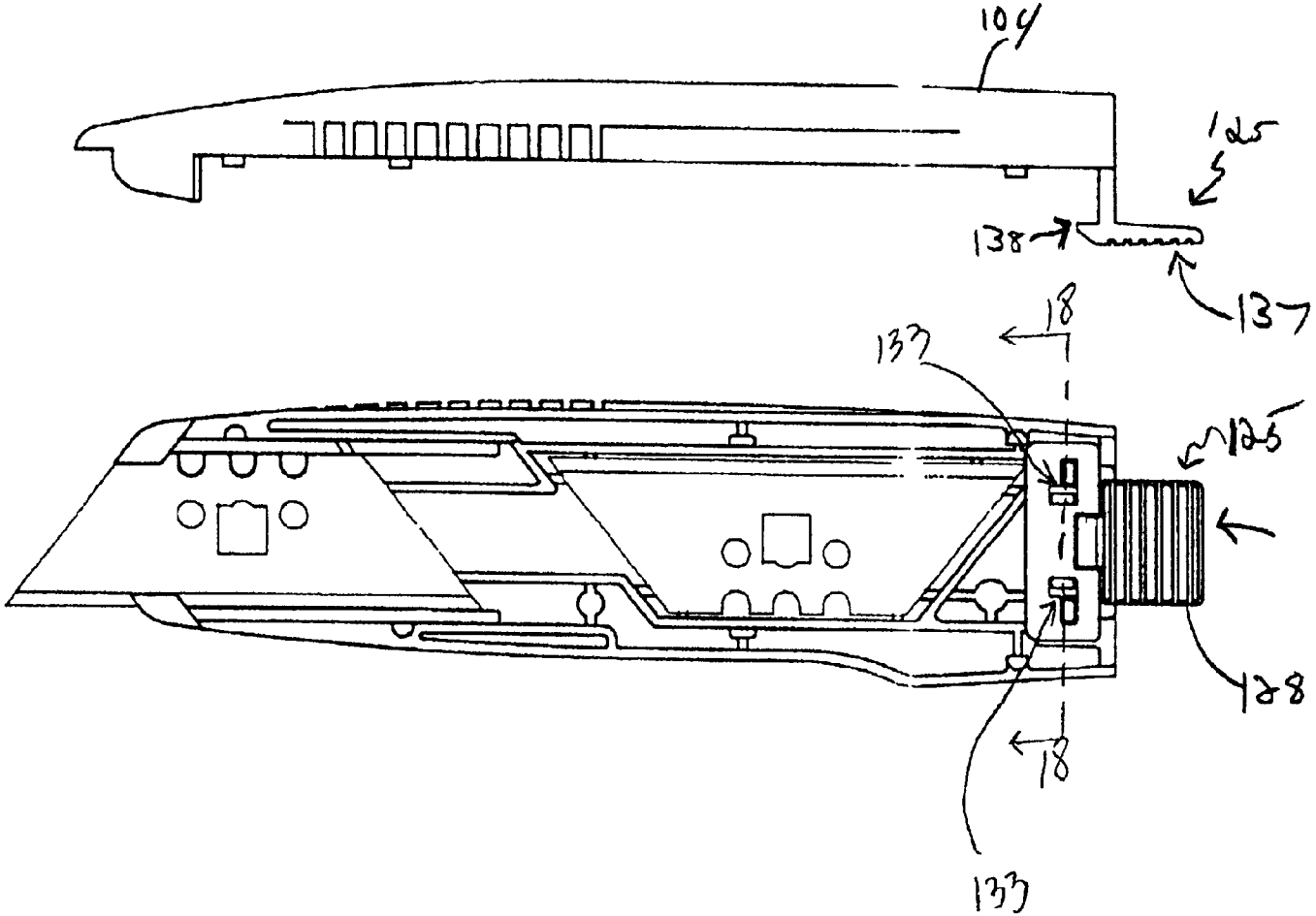
FIG. 16A is a top view of the upper housing of an alternative embodiment of the invention with the lower housing removed and with the locking mechanism of the invention installed.
FIG. 16B is a left side view of the upper housing shown in FIG. 16A.
Figure 18:
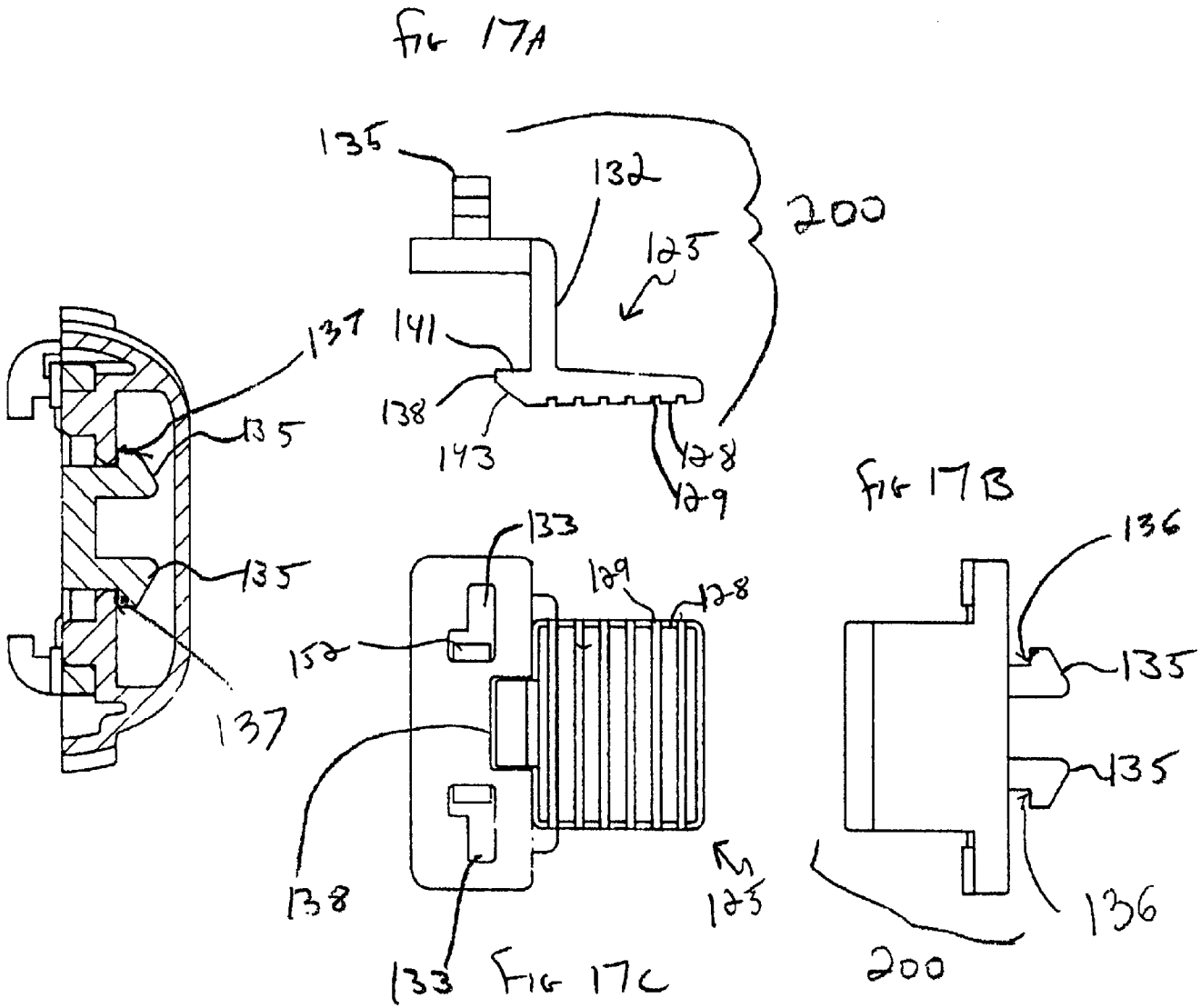
FIG. 18 is a section view through Section 18—18 of FIG. 16B.

In an alternative embodiment, as shown in FIGS. 16–18, locking assembly 200 is freestanding and is not attached to return spring 6 or blade carrier 12. In this embodiment, locking assembly 200 can be used either in an automatically retractable or indexed knife. Moreover, locking assembly 200 may be used with a utility knife constructed of any material, including metals, in order to enable such knives to be used with a quick release locking mechanism. Locking mechanism 200 is preferably constructed of a flexible material, such as a molded thermoplastic.

In order to attach locking assembly 200 to upper housing 104, extensions 135 are inserted into an attachment aperture (defined by edges 137) on upper housing 104. During insertion into attachment aperture 137, extensions 135 flex inwardly until shoulders 136 are able to engage with and lock against aperture 137. Once inserted into aperture 137, locking mechanism 200 is preferably fixed within the aperture. Locking mechanism 200 may also include apertures 133 through which pins 116 on upper housing 104 frictionally engage locking mechanism 200 to stabilize and align the locking mechanism.

As in the prior embodiment, the lower housing preferably includes a locking aperture and a shoulder on the peripheral edge of the locking aperture, and locking mechanism 200 includes a locking arm 125 that is adapted to snap-fit into the locking aperture. Locking arm 125 preferably includes an upwardly extending portion 132, an actuating arm 128 preferably having a plurality of ribs 129 providing a gripping surface, and a locking lip 138 having flat under surface 141. Flat under surface 141 is adapted to frictionally engage the shoulder on the peripheral edge of the locking aperture. Locking arm 125 also preferably includes a tapered surface 143 adjacent to flat under surface 141, where tapered surface 143 is adapted to slidably engage an underside of the shoulder. As the upper housing is pushed together with the lower housing, locking arm 125 releasably engages the locking aperture on the lower housing.

In order to open the housing, downward pressure is applied onto actuating arm 128 of locking arm 125. As force is applied to actuating arm 128, upwardly extending portion 132 bends slightly, and eventually advances past the shoulder on the lower housing to release the upper and lower sections of the housing.

Although the present invention has been described in detail with respect to certain embodiments and examples, variations and modifications exist that are within the scope of the present invention as defined in the following claims.

What is claimed is:

1. A cutting device comprising:

a housing comprising first and second separable portions, the first portion comprising a locking aperture, the second portion comprising an attachment aperture; and a locking apparatus for removably attaching the first and second portions of the housing, the locking apparatus comprising an attachment portion adapted to be fixedly attached in the attachment aperture when the first and second separable portions are joined and aligned and when the first and second separable portions are separated for replacement of a blade, and a locking arm adapted to be releasably locked into the locking aperture to secure the separable portions together, wherein the locking arm comprises i) an upstanding portion oriented generally perpendicular to an axis of the housing, ii) an actuating arm extending laterally from a free end of the upstanding portion, so that downward force on the actuating arm causes a bending of the upstanding portion, and iii) a locking lip on the free end of the upstanding portion extending laterally in a direction opposite to the direction of bending of the upstanding portion.

2. A cutting device comprising:

a housing comprising a first and second separable portions, the first portion comprising a locking aperture, the second portion comprising an attachment aperture; and a locking apparatus for removably attaching the first and second portions of the housing, the locking apparatus comprising an attachment portion adapted to be fixedly attached in the attachment aperture, and a locking arm adapted to be releasably locked into the locking aperture, wherein the locking apparatus further comprises a return spring and blade carrier integrally molded therewith.

3. In an improved cutting device having a housing formed of first and second portions, a return spring, and a blade carrier biased by the return spring, the improvement comprising: a locking apparatus for releasably attaching the first and second portions of the housing, the locking apparatus being integrally molded with the return spring and the blade carrier, wherein the first portion of the housing comprises a locking aperture, and the second portion of the housing comprises an attachment aperture; and the locking apparatus comprises an attachment portion for being fixedly attached in the attachment aperture, and a locking arm adapted to be removably locked into the locking aperture.

4. The improved cutting device according to claim 3, wherein the attachment aperture and locking aperture are correspondingly positioned wherein the locking arm becomes aligned with the locking aperture when the first and second portions of the housing are aligned for assembly.

5. The cutting device according to claim 3, wherein the locking arm comprises i) an upstanding portion oriented generally perpendicular to an axis of the housing, ii) an actuating arm extending laterally from a free end of the upstanding portion, so that downward force on the actuating arm causes a bending of the upstanding portion, and iii) a locking lip on the free end of the upstanding portion extending laterally in a direction opposite to the direction of bending of the upstanding portion.

6. The cutting device according to claim 3, wherein the attachment aperture comprises an attachment shoulder, and wherein the attachment portion of the locking apparatus comprises at least one extension for being locked in the attachment aperture against the attachment shoulder.

7. A cutting device comprising:

a housing comprising first and second separable portions, the first portion comprising a locking aperture, the second portion comprising an attachment aperture; and a locking apparatus for removably attaching the first and second portions of the housing, the locking apparatus comprising an attachment portion adapted to be fixedly attached in the attachment aperture when the first and second separable portions are joined and aligned and when the first and second separable portions are separated for replacement of a blade, and a locking arm adapted to be releasably locked into the locking aperture to secure the separable portions together, wherein the locking apparatus further comprises a return spring and blade carrier integrally molded therewith.

8. In an improved cutting device having a housing formed of first and second portions, a return spring, and a blade carrier biased by the return spring, the improvement comprising: a locking apparatus for releasably attaching the first and second portions of the housing to selectively secure the first and second portions of the housing together for use as a handle of the cutting device, the locking apparatus being integrally molded with the return spring and the blade carrier wherein the first portion of the housing comprises a locking aperture, and the second portion of the housing comprises an attachment aperture; and the locking apparatus comprises an attachment portion for being fixedly attached in the attachment aperture, and a locking arm adapted to be removably locked into the locking aperture.

9. The improved cutting device according to claim 8, wherein the attachment aperture and locking aperture are correspondingly positioned wherein the locking arm becomes aligned with the locking aperture when the first and second portions of the housing are aligned for assembly.

10. The cutting device according to claim 8, wherein the locking arm comprises i) an upstanding portion oriented generally perpendicular to an axis of the housing, ii) an actuating arm extending laterally from a free end of the upstanding portion, so that downward force on the actuating arm causes a bending of the upstanding portion, and iii) a locking lip on the free end of the upstanding portion extending laterally in a direction opposite to the direction of bending of the upstanding portion.

11. The cutting device according to claim 8, wherein the attachment aperture comprises an attachment shoulder, and wherein the attachment portion of the locking apparatus comprises at least one extension for being locked in the attachment aperture against the attachment shoulder.

* * * * *